US006688914B1

(12) United States Patent
Espenshade et al.

(10) Patent No.: US 6,688,914 B1
(45) Date of Patent: Feb. 10, 2004

(54) STACKED ELECTRICAL CONNECTOR ASSEMBLY HAVING EASILY DETACHABLE ELECTRONIC MODULE

(75) Inventors: Leonard K. Espenshade, Harrisburg, PA (US); Kevin E. Walker, Hershey, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/236,614

(22) Filed: Sep. 6, 2002

(51) Int. Cl.[7] ..... H01R 13/60; H01R 13/648

(52) U.S. Cl. ..... 439/541.5; 439/607

(58) Field of Search ..... 439/541.5, 607; 174/35 C

(56) References Cited

U.S. PATENT DOCUMENTS

| | | | | |
|---|---|---|---|---|
| 5,587,884 | A | 12/1996 | Raman | |
| 6,155,872 | A | 12/2000 | Wu | |
| 6,162,089 | A | 12/2000 | Costello et al. | |
| 6,183,292 | B1 * | 2/2001 | Chen et al. | 439/541.5 |

* cited by examiner

*Primary Examiner*—Hung V. Ngo
(74) *Attorney, Agent, or Firm*—Wei Te Chung

(57) ABSTRACT

An electrical connector assembly (1) includes an insulative main housing (2) defining an upper cavity (21), a contact module (3) received in the upper cavity, and an electronic module (6) electrically connecting with the contact module for transmitting signals and eliminating undesirable noises. A pair of posts (26) projects from the main housing. The electronic module includes a receptacle portion (61). A pair of cutouts (613) are defined in the receptacle portion corresponding to and engaging with the post of the main housing, thereby mounting the electronic module on the main housing.

17 Claims, 9 Drawing Sheets

STACKED ELECTRICAL CONNECTOR ASSEMBLY HAVING EASILY DETACHABLE ELECTRONIC MODULE

CROSS-REFERENCE TO RELATED APPLICATION

The present application is related to a U.S. patent application entitled to "ELECTRICAL CONNECTOR ASSEMBLY HAVING GROUND MEMBER", invented by Leonard Kay Espenshade and Kevin Eugene Walker, the application entitled to "SHIELDED ELECTRICAL CONNECTOR ASSEMBLY HAVING RELIABLE GROUNDING CAPABILITIES", invented by Leonard Kay Espenshade, the application entitled to "STACKED CONNECTOR WITH LEDS AND METHOD OF PRODUCING THE SAME", invented by Kevin Eugene Walker and Leonard Kay Espenshade, the application entitled to "STACKED CONNECTOR WITH LEDS", invented by Leonard Kay Espenshade and Kevin Eugene Walker, and the application entitled to "STACKED CONNECTOR WITH REAR COVER ASSEMBLED THERETO", invented by Kevin Eugene Walker, James Henry Hyland, Tod Martin Harlan and Robert William Brown, contemporaneously filed and all assigned to the common assignee. Copies of the specifications are hereto attached.

BACKGROUND OF THE INVENTION

1. Field of the Invention

The present invention relates to an electrical connector assembly, and more particularly to an electrical connector assembly having an easily detachable electronic module.

2. Description of the Prior Art

In a Local Area Network (LAN), a plurality of modular jacks are introduced to interconnect computers and servers through an infrastructure. As a result, information as well as data can be freely and quickly communicated within the LAN. In order to get a higher performance, such as 100 Mbps transmitting rate, more modular jacks tend to incorporate signal conditioning subassemblies for eliminating undesirable extraneous signals, such as high frequency noise, common mode noise and DC voltage from twisted pair lines.

U.S. Pat. No. 5,587,884 issued to Raman on Dec. 24, 1996 discloses a modular jack. The Raman modular jack comprises an insulative housing 4 and an insert member 10 received by the housing 4. The housing 4 has a pair of latches 28 therein. The insert member 10 receives signal conditioning components for eliminating undesired noises and comprises a pair of wedge-shaped snap latches 32 projecting from opposite sides thereof. When the insert member 10 is fully inserted in the housing 4, the snap latches 32 of the insert member 10 engages respectively with the lathes 28 of the housing 4, thereby retaining the insert member 10 in the housing 4. In some cases, it is desirable to replace the insert member 10 from the housing 4 for purposes of repair or modification. However, because the latches 28 of the housing 4 retain the snap latches 32 of the insert member 10, it is difficult to replace the insert member 10 from the housing 4.

Hence, an improved electrical connector assembly is required to overcome the disadvantages of the prior art.

BRIEF SUMMARY OF THE INVENTION

A main object of the present invention is to provide an electrical connector assembly which has an easily detachable electronic module.

An electrical connector assembly in accordance with the present invention comprises an insulative main housing defining an upper cavity, a contact module received in the upper cavity, an electronic module mounted on the main housing. The main housing comprises a pair of posts projecting therefrom. The electronic module connects electrically with the contact module for transmitting signals and eliminating undesirable noises and comprises a receptacle portion. The receptacle portion defines a pair of cutouts corresponding to and engaging with the post of the main housing, thereby mounting the electronic module on the main housing. Clearly, the electronic module is easily mount/replace on/from the main housing.

Other objects, advantages and novel features of the invention will become more apparent from the following detailed description when taken in conjunction with the accompanying drawings.

DETAILED DESCRIPTION OF THE INVENTION

Figure 1:
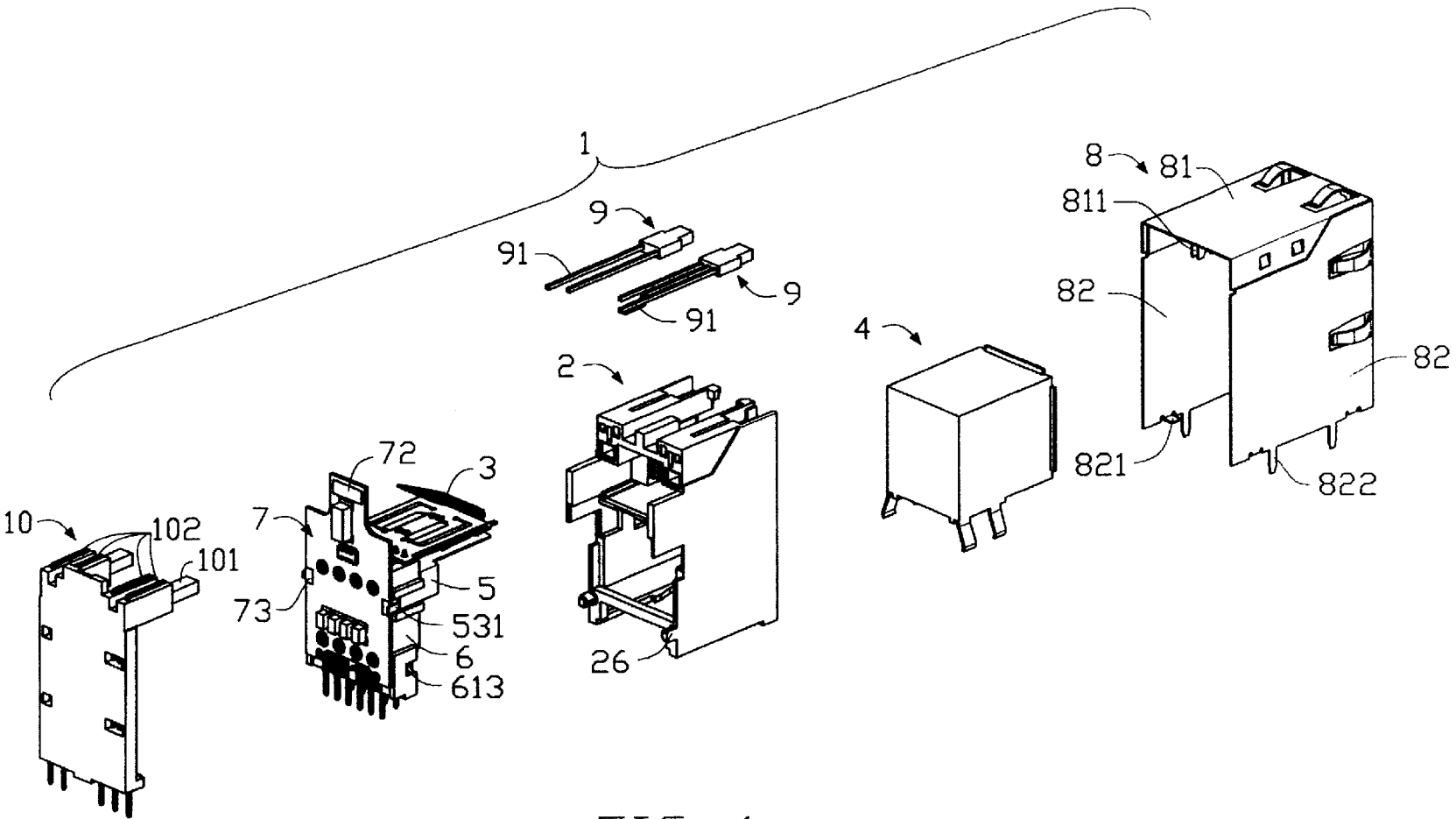
FIG. 1 is an exploded view of an electrical connector assembly according to the present invention.
Figure 2:
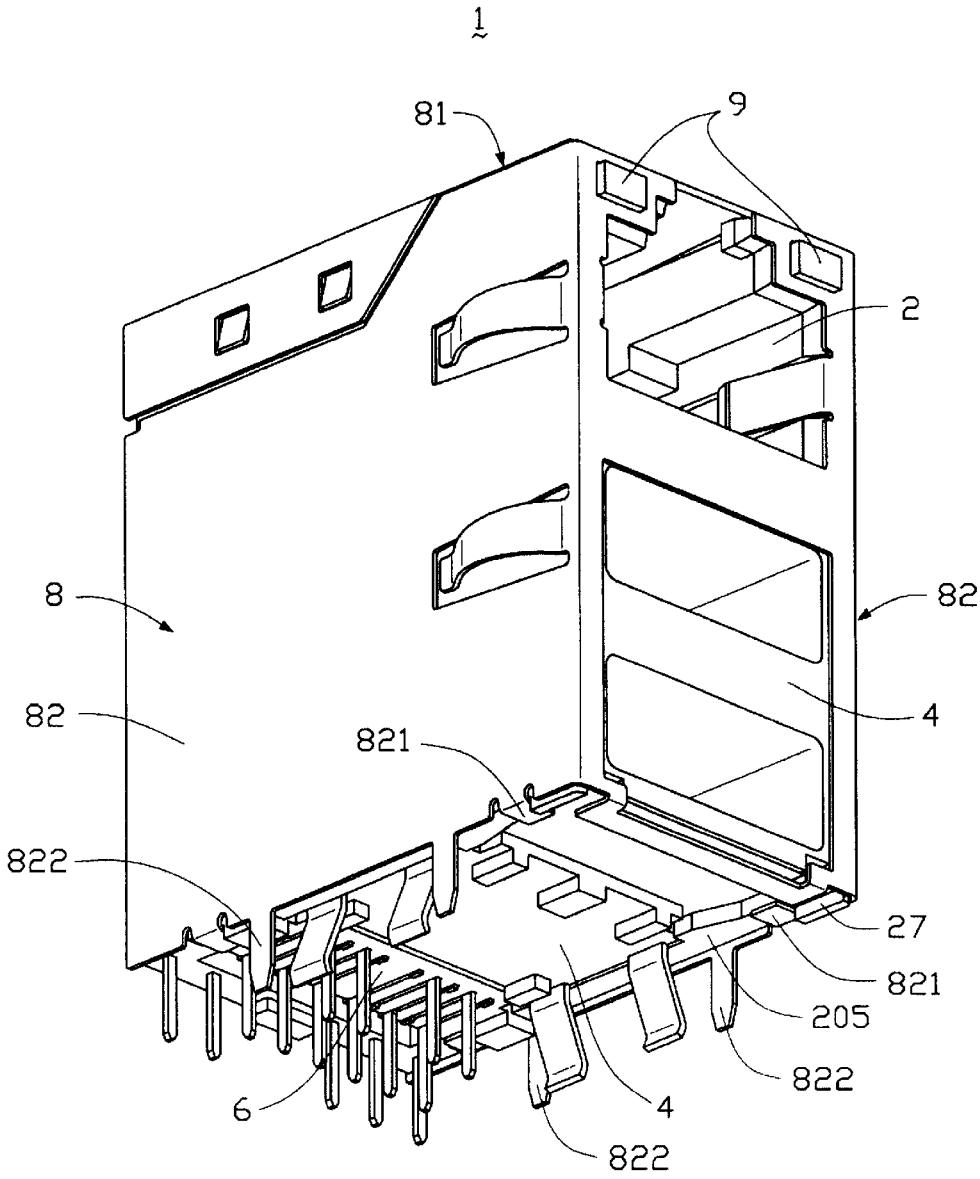
FIG. 2 is an assembled view of FIG. 1.
Figure 3:
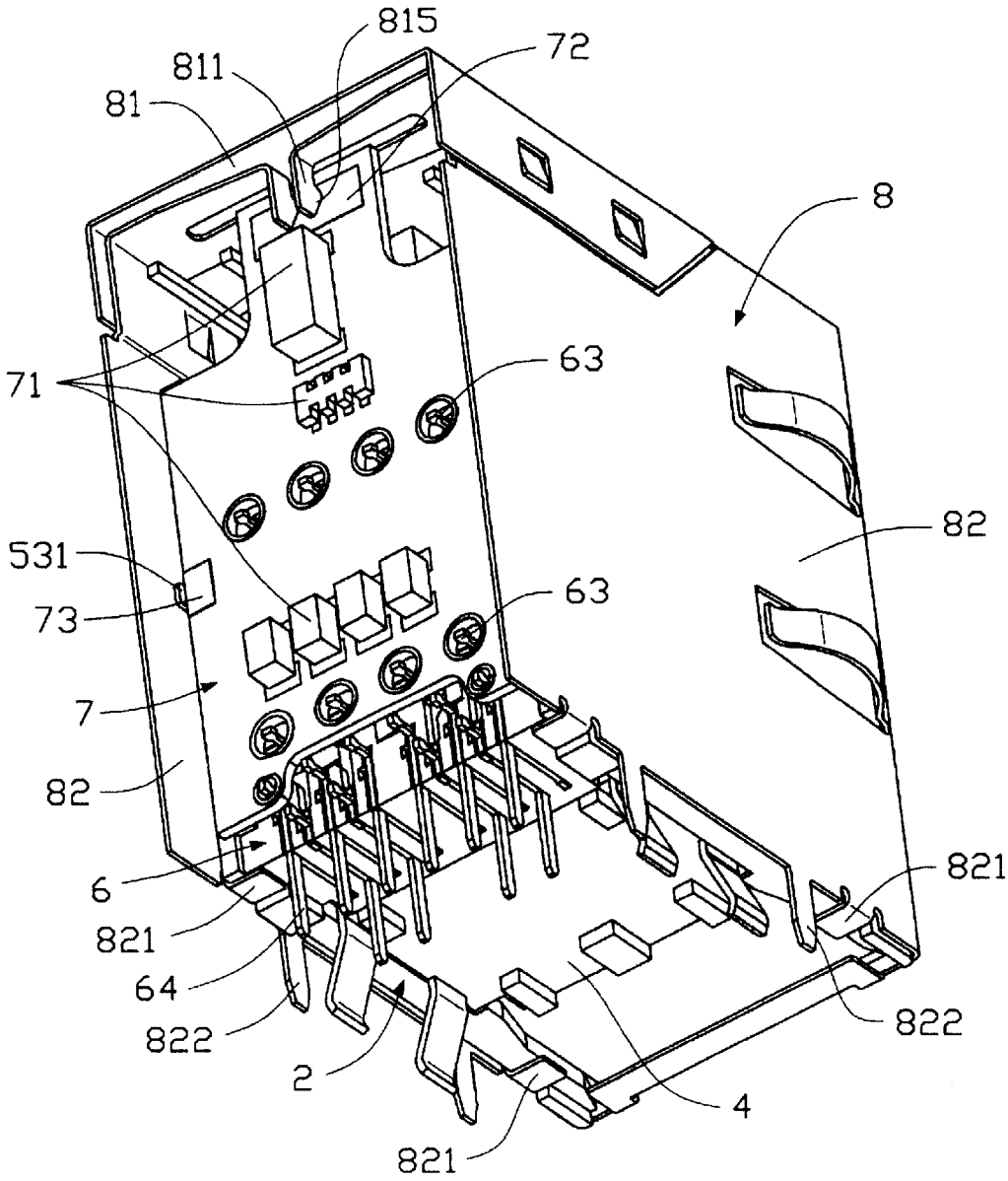
FIG. 3 is another assembled view of FIG. 1, with a rear cover removed for clarity.

Referring to FIGS. 1, 2 and 3, a stacked electrical connector assembly 1 according to the present invention comprises an insulative main housing 2, a contact module 3, a stacked Universal Serial Bus (USB) connector 4, a ground member 5, an electronic module 6 mounted on the main housing 2, a daughter printed circuit board (PCB) 7 mounted on the electronic module 6, a metallic shield 8 substantially enclosing the main housing 2, a pair of Light Emitting Diodes (LEDs) 9 and a rear cover 10.

Figure 4:
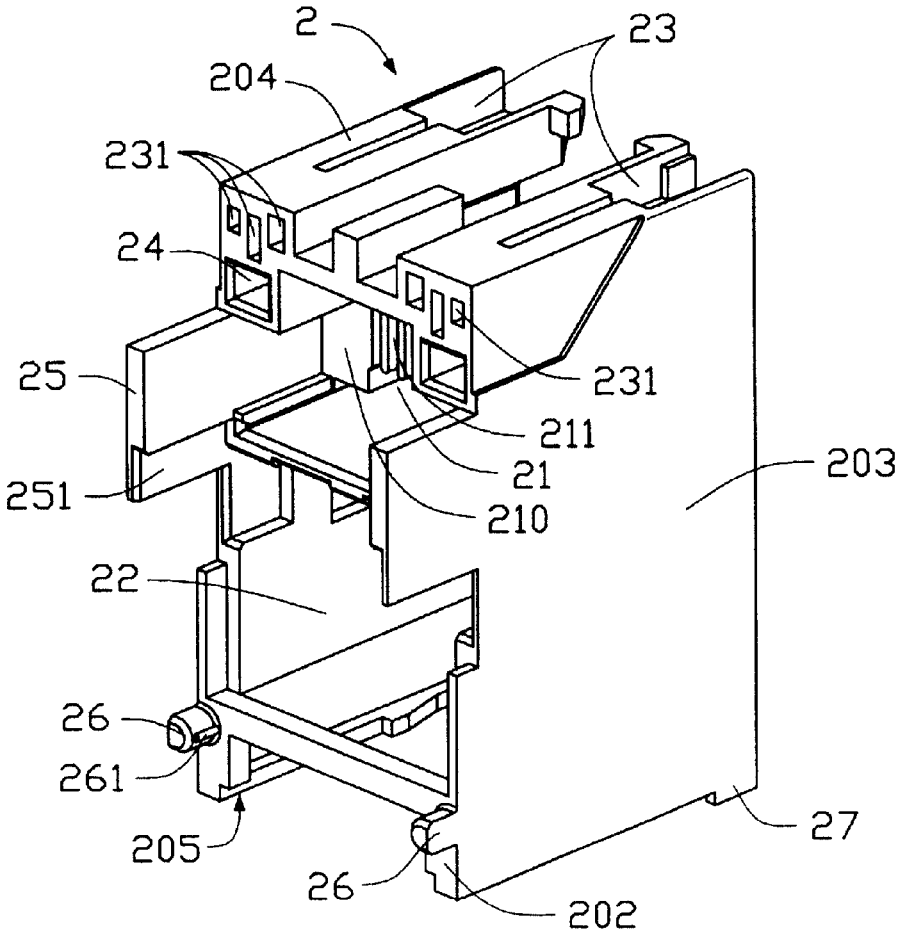
FIG. 4 is a perspective view of a main housing of the electrical connector assembly.
Figure 5:
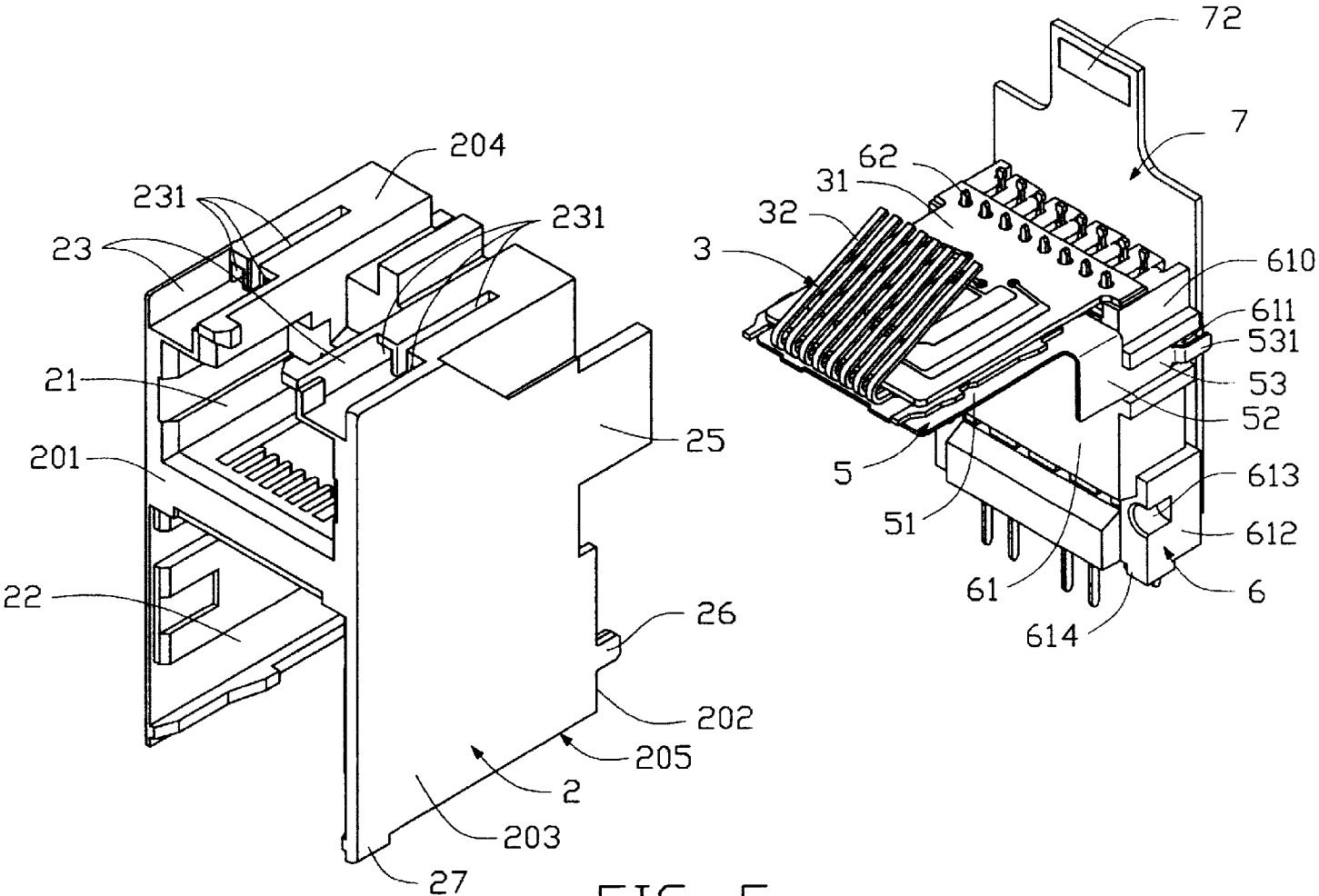
FIG. 5 is a partially view of the electrical connector assembly, showing the main housing, a contact module, a ground member, an electronic module and a daughter printed circuit board (PCB) of the electrical connector assembly.

Referring to FIGS. 4 and 5, the main housing 2 is mounted on a mother printed circuit board (not shown, PCB) of an electrical device. The main housing 2 is substantially cubic and comprises a front and rear walls 201, 202, opposite sidewalls 203, a top wall 204 and a bottom wall 205. The main housing 2 defines an upper cavity 21 and a lower cavity 22. The upper cavity 21 is defined through the front and the rear walls 201, 202 for receiving the contact module 3. The lower cavity 22 is defined through the front, the rear and the bottom walls 201, 202, 205 for receiving the stacked USB connector 4. A comb portion 210 extends downwardly from the top wall 204 into the upper cavity 21. The comb portion 210 defines a plurality of parallel retaining slits 211 communicating with the upper cavity 21. A pair of spaces 23 are defined in opposite side portions of the front and the top walls 201, 204. A pair of groups of three channels 231 are respectively defined through the rear wall 202 and communicate with corresponding spaces 23. A pair of mating holes 24 are defined in the rear wall 202 adjacent to corresponding three channels 231 for fixing the rear cover 10. Each sidewall 203 comprises a flange 25 projecting rearwardly from an upper portion and beyond the rear wall 202. Each flange 25 defines a notch 251 in a lower portion of an inner face thereof. A pair of semicylindric posts 26 project rearwardly from side portions of a lower portion of the rear wall 202. The posts 26 align with corresponding flanges 25 with cylindrical surfaces thereof face to each other. Each post 26 has an inwardly projecting ridge 261 extending longitudinally along the cylindrical surface thereof. A pair of standoffs 27 downwardly project from the bottom wall 205 for mounting on the mother PCB of the electrical device.

The contact module 3 is received in the upper cavity 21 and comprises a horizontal compensation PCB 31 and a plurality of parallel conductive terminals 32 mounted on the compensation PCB 31. Further referring to FIG. 6, each terminal 32 comprises an elongate solder section 321 soldered to a bottom surface of the compensation PCB 31, and a spring engaging section 322 inclinedly extending above a top surface of the compensation PCB 31 with a free end thereof retained in a corresponding retaining slit 211 of the main housing 2. The stacked USB connector 4 is received in the lower cavity 22 of the main housing 2.

Figure 6:
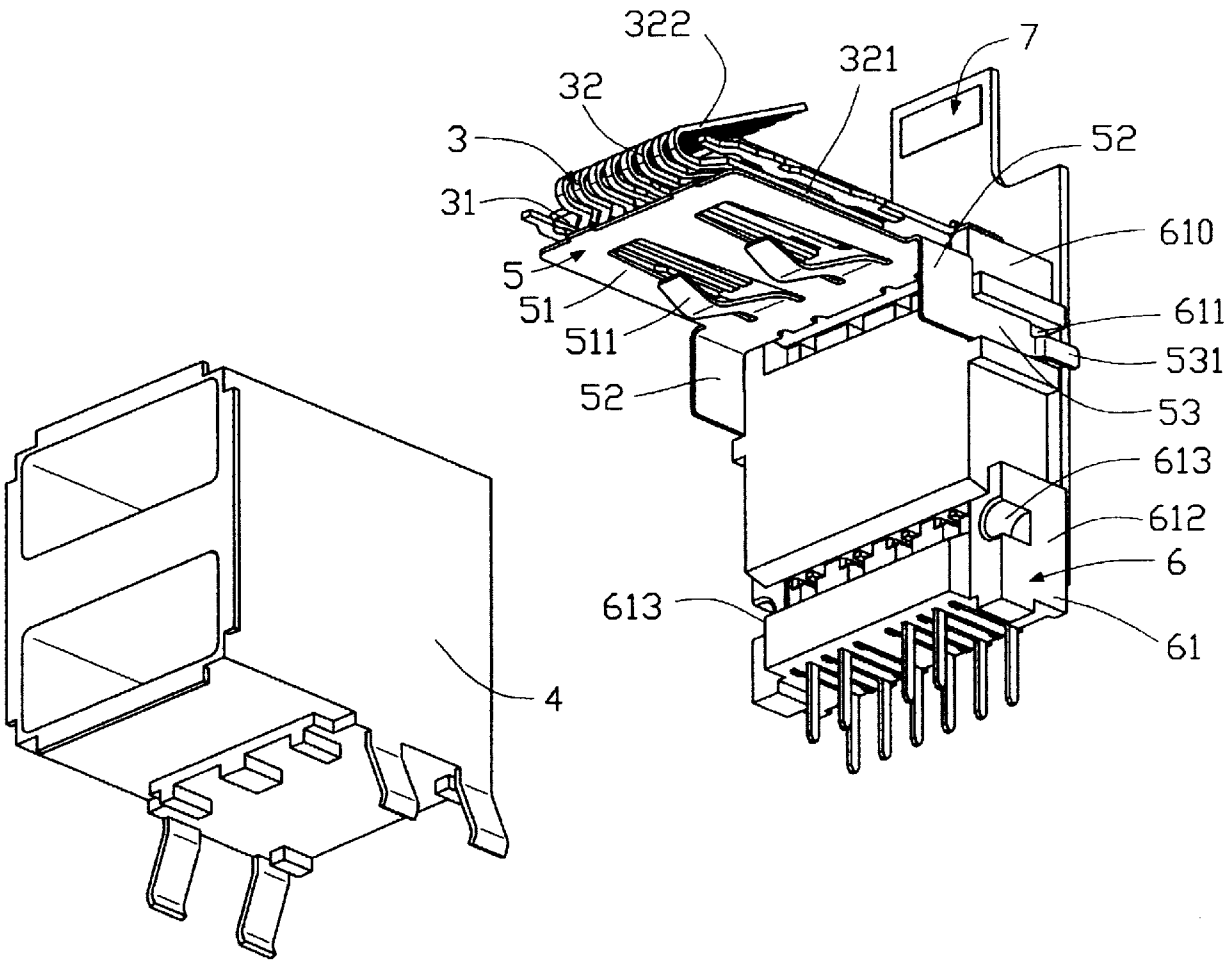
FIG. 6 is another partially view of the electrical connector assembly, showing the contact module, the ground member, the electronic module, the daughter PCB and a stacked Universal Serial Bus (USB) connector of the electrical connector assembly.
Figure 7:
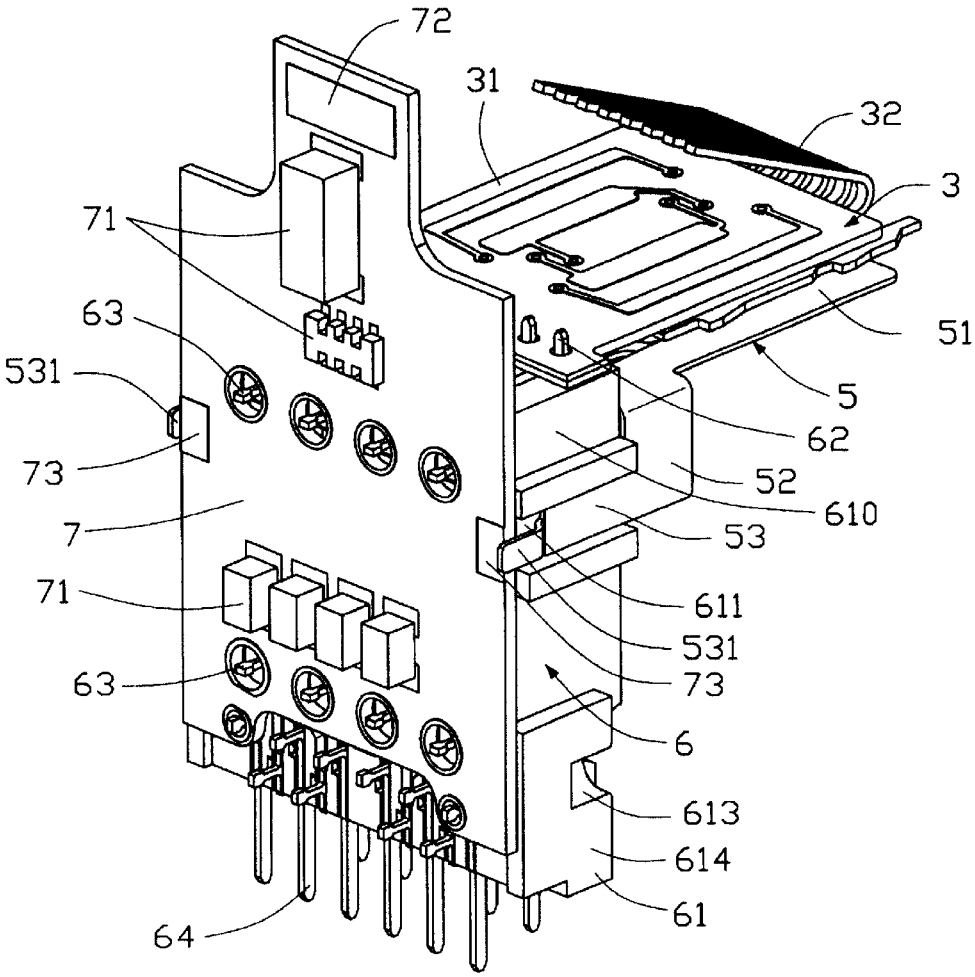
FIG. 7 is a further partially view of the electrical connector assembly, showing the contact module, the ground member, the electronic module and the daughter PCB of the electrical connector assembly.

Referring to FIGS. 6 and 7, the ground member 5 is fabricated from a conductive metal sheet and comprises a rectangular body portion 51, a pair of upright linking portion 52 downwardly depending from rear portions of opposite side edges of the body portion 51 and a pair of solder portions 53 rearwardly extending from rear edges of corresponding linking portions 52. The body portion 51 is stamped out a pair of spring fingers 511 with free ends substantially extending forwardly and downwardly. The body portion 51 is inserted in the lower cavity 22 (shown in FIG. 4) with spring fingers 511 elastically abutting against an upper face of the stacked USB connector 4. A solder tail 531 extends slightly and outwardly from a rear portion of each solder portion 53 beyond the daughter PCB 7.

Figure 8:
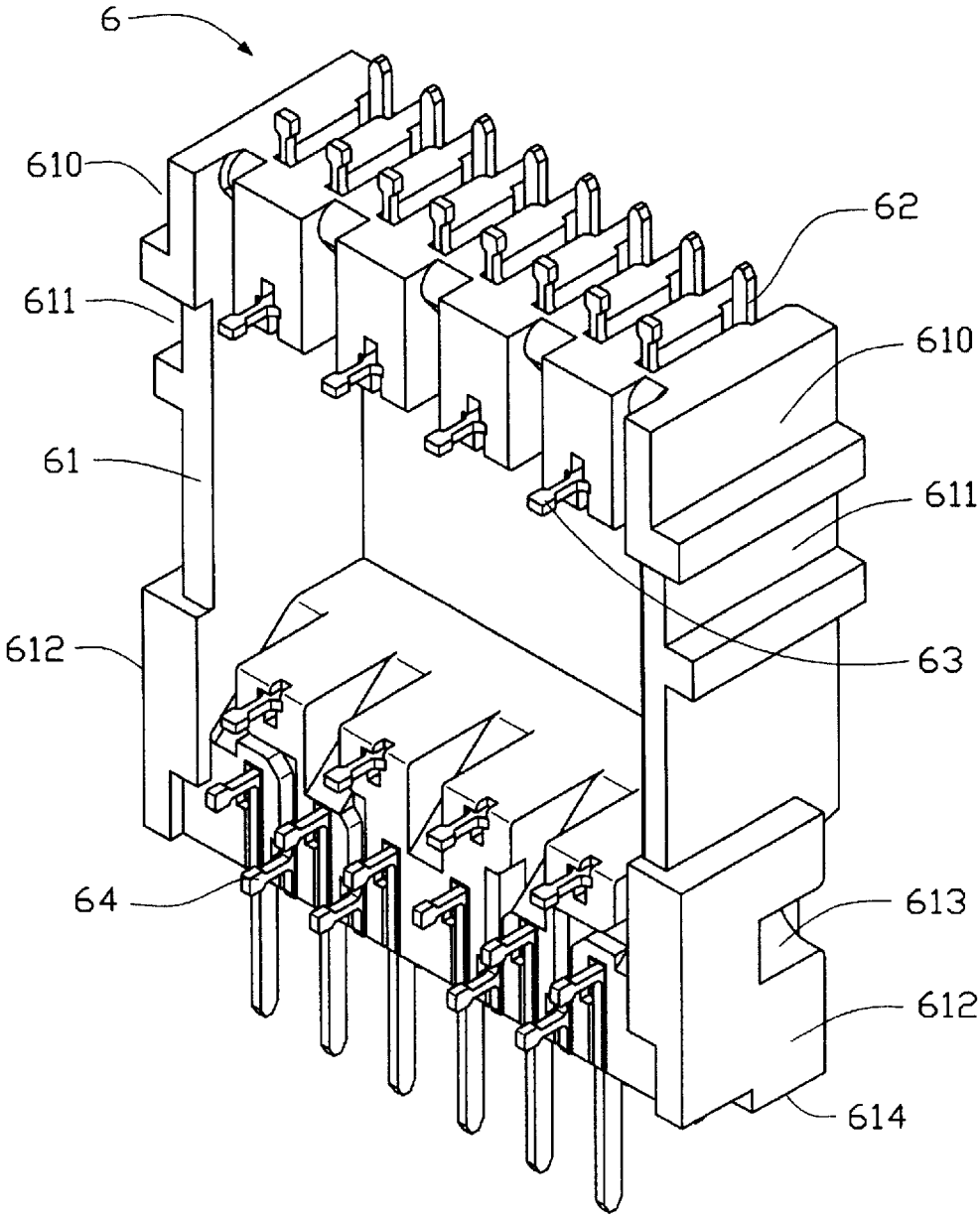
FIG. 8 is a perspective view of the electronic module of the electrical connector assembly.

Referring to FIGS. 7 and 8, in this embodiment, the electronic module 6 is a magnetic module and is mounted onto the rear wall 202 of the main housing 2 and comprises an insulative receptacle portion 61, a plurality of first, second and third contacts 62, 63 and 64 retained by the receptacle portion 61. The receptacle portion 61 is substantially cubic and receives a plurality of magnetic coils (not shown) interconnecting the first, the second and the third contacts 62, 63 and 64 in a certain manner.

A pair of recesses 610 are respectively defined in an upper portion of opposite sidewalls 612 of the receptacle portion 61 for facilitating engaging with the notches 251 (shown in FIG. 4) of the main housing 2, thereby retaining the electronic module 6 on the main housing 2. The receptacle portion 61 horizontally defines a pair of grooves 611 in a middle portion of corresponding opposite sidewalls 612 for retaining corresponding solder portions 53 of the ground member 5 therein. A pair of semicylindric cutouts 613 are respectively defined in lower portions of the sidewalls 612. The cutouts 613 expose forwardly for engaging with corresponding posts 26 of the main housing 2, whereby the electronic module 6 is mounted on the main housing 2. A pair of stand-offs 614 downwardly extend from a bottom surface of the receptacle portion 61 for mounting on the mother PCB.

The first contacts 62 extend beyond a top surface of the receptacle portion 61 to electrically connect with the compensation PCB 31 of the contact module 3. The second contacts 63 project from a rear surface of the receptacle portion 61 to electrically connect with the daughter PCB 7. The third contacts 64 project beyond a bottom surface of the receptacle portion 61 to solder to the mother PCB.

Particularly referring to FIGS. 6 and 7, the daughter PCB 7 is mounted on a rear surface of the receptacle portion 61 of the electronic module 6 and carries a plurality of signal conditioning components 71 on a rear surface thereof for eliminating undesirable extraneous signals such as high frequency noises. A pair of contact pads 72 are attached on top portions of opposite surfaces of the daughter PCB 7. A pair of solder pads 73 are formed on side portions of the rear surface of the daughter PCB 7 and are soldered with the solder tails 531 of the ground member 5. Therefore, a continuous ground connection is established between the stacked USB connector 4 and the daughter PCB 7.

Figure 9:
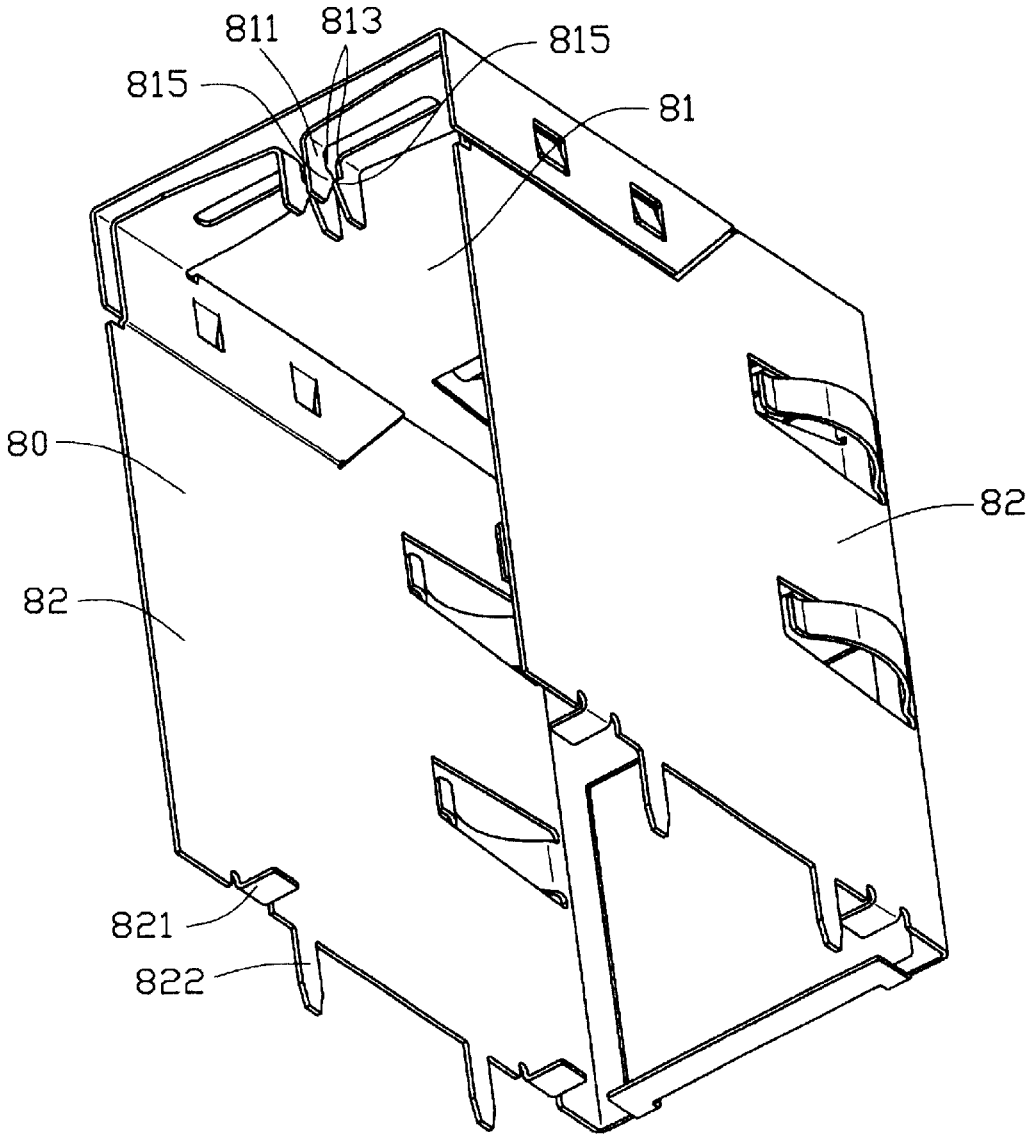
FIG. 9 is a perspective view of a shield of the electrical connector assembly.

Referring to FIGS. 3 and 9, the shield 8 comprises a top wall 81 and opposite side walls 82. A chamber 80 is defined by the top wall 82 and the side walls 82 for substantially enclosing the main housing 2, the electronic module 6 and the daughter PCB 7. The top wall 81 comprises an upper layer (not labeled) and a lower layer (not labeled). Two pairs of contacting legs 811 extend downwardly from a rear portion of the lower layer of the top wall 81 and are arranged in two juxtaposed lines. Each pair of contacting legs 811 is parallel to the side walls 82 of the shield 8 with inner side edges 813 facing to each other. A pair of contacting feet 815 are respectively formed on the inner side edges 813 of each pair of contacting legs 811 and project to each other for securely clamping the upper portion of the daughter PCB 7 therebetween, thereby electrically contacting corresponding contact pads 72 of the daughter PCB 7. Each side wall 82 forms a pair of downwardly projecting mounting legs 822 for soldering to the mother PCB. Therefore, a continuous ground connection is established between the daughter PCB 7 and the mother PCB. Each side wall 82 also forms a pair of retention tabs 821 inwardly bent to abut against the bottom wall 205 of the main housing 2 for retaining the shield 8 with the main housing 2.

Referring to FIGS. 1 and 4, the LEDs 9 are respectively received in the spaces 23 of the main housing 2 with tails 91 rearwardly extending through corresponding channels 231.

The rear cover 10 comprises a pair of forwardly projecting mating poles 101 for engaging with the mating holes 24 of the main housing 2 and a plurality of contacts 102 extending forwardly to electrically connect with corresponding tails 91 of the LEDs 9.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an insulative main housing defining a cavity therein, and forming a post projecting outwardly therefrom;

a contact module received in the cavity of the main housing, the contact module comprising a compensation printed circuit board (PCB) extending in a first direction and a plurality of terminals mounted on the compensation PCB; and an electronic module mounted on the insulative main housing and electrically connecting with the contact module, and comprising a receptacle portion, a cutout being defined in the receptacle portion engaging with the post of the main housing, the electronic module comprising a plurality of first contacts electrically connecting with the compensation PCB.

2. The electrical connector assembly as claimed in claim 1, wherein the post projects rearwardly from a rear wall of the main housing, and the cutout of the electronic module exposes forwardly to engage with the post of the main housing.

3. The electrical connector assembly as claimed in claim 1, wherein the post of the main housing is semicylindric and has a cylindrical surface, and wherein the cutout of the electronic module is semicylindric corresponding to the post of the main housing.

4. The electrical connector assembly as claimed in claim 3, wherein the post of the main housing forms a projecting ridge extending along the cylindrical surface thereof.

5. The electrical connector assembly as claimed in claim 1, wherein the receptacle portion of the electronic module is disposed in a second direction perpendicular to the first direction of the compensation PCB extending.

6. The electrical connector assembly as claimed in claim 5, further comprising a daughter PCB carrying a plurality of filter members and extending in a third direction parallel to the second direction, and wherein the electronic module comprises a plurality of second contacts electrically connecting with the daughter PCB.

7. The electrical connector assembly as claimed in claim 1, wherein the electronic module is a magnetic module receiving a plurality of magnetic coils.

8. An electrical connector assembly comprising:

an insulative main housing defining a cavity and comprising a wall;

a contact module received in the cavity of the main housing;

a vertical daughter board electrically connected to the contact module;

an electronic module electrically connecting to both the contact module and the daughter board, and assembled to the insulative main housing; and an interengaging device arranged between the main housing and the electronic module so as to attach the electronic module to the main housing.

9. The electrical connector assembly as claimed in claim 8, wherein the interengaging device comprises a post and a cutout.

10. The electrical connector assembly as claimed in claim 9, wherein the post projects from the wall of the main housing in a first direction, and wherein the cutout is defined in the electronic module in a second direction opposite to the first direction and engages with the post of the main housing.

11. An electrical connector assembly comprising:

an insulative housing defining therein upper and lower cavities;

a connector module received in the lower cavity;

a contact module received in the upper cavity in a horizontal direction;

a vertical daughter board electrically connected to the contact module;

an electronic module mechanically and electrically to both said contact module and said daughter board; and means for engaging the housing and the electronic module with each other so as to limit relative vertical movement therebetween.

12. The assembly as claimed in claim 11, wherein said electronic module has two sets of contacts respectively extending from upper and lower face thereof for electrically connecting to the contact module and a mother board on which the housing is seated.

13. The assembly as claimed in claim 11, wherein the electronic module is a magnetic module receiving a plurality of magnetic coils.

14. The assembly as claimed in claim 11 wherein the means comprises a post and a cutout.

15. The assembly as claimed in claim 14, wherein the post horizontally projects from the insulative housing, and wherein the cutout is defined in the electronic module and engages with the post of the insulative housing.

16. The assembly as claimed in claim 11, wherein the insulative housing comprises a flange projecting rearwardly, and wherein the electronic module defines a recess corresponding to and engaging with the flange of the insulative housing.

17. The assembly as claimed in claim 11, wherein the contact module comprises a compensation printed circuit board (PCB) extending horizontally and a plurality of terminals mounted on the compensation PCB.

* * * * *